United States Patent [19]

Maisonneuve

[11] 4,109,826

[45] Aug. 29, 1978

[54] CONTAINER AND DISPENSING PACKAGE

[76] Inventor: Leo V. Maisonneuve, 4480 N. 40th St., St. Petersburg, Fla. 33714

[21] Appl. No.: 730,846

[22] Filed: Oct. 8, 1976

[51] Int. Cl.[2] ..... B65D 5/38

[52] U.S. Cl. ..... 221/72; 221/89; 229/11; 229/20; 229/87 F

[58] Field of Search ..... 221/25, 70, 71, 72, 221/85, 86, 89; 229/9, 10, 11, 19, 20, 27, 87 F; 206/443, 526

[56] References Cited

U.S. PATENT DOCUMENTS

| | | | |
|---|---|---|---|
| 2,119,019 | 5/1938 | Martin | 221/86 |
| 2,474,166 | 6/1949 | Rumsey | 229/20 X |
| 3,550,809 | 12/1970 | Maisonneuve | 221/25 |
| 3,613,142 | 10/1971 | Chaney | 221/25 X |

FOREIGN PATENT DOCUMENTS

| | | | |
|---|---|---|---|
| 593,522 | 2/1934 | Fed. Rep. of Germany | 221/70 |
| 916,012 | 1/1963 | United Kingdom | 229/10 |

*Primary Examiner*—Robert B. Reeves

*Assistant Examiner*—Francis J. Bartuska

*Attorney, Agent, or Firm*—Arthur W. Fisher, III

[57] ABSTRACT

A container and dispensing package comprising an outer carton, an inner wrapper and an expendable tray. The outer carton comprises an enclosure to house the inner wrapper and expandable tray containing cube sticks of foodstuffs such as butter. The expandable tray comprises a single or unitary cardboard member folded to form a plurality of separate substantially U-shaped compartments of troughs. The inner wrapper is attached to the rear of the outer carton such that light pulling of the outer flap by the user pulls the expandable tray out of the carton in an accordion-like fashion leaving the cube sticks on the floors of the troughs whose sides or partitions have fallen away. Retainers are formed by cutting away portions of adjacent partitions to form flaps which lie against the top of the outer carton and act as guards to prevent the cube sticks from sticking to the inner wrapper so that they won't tumble out of the carton.

6 Claims, 6 Drawing Figures

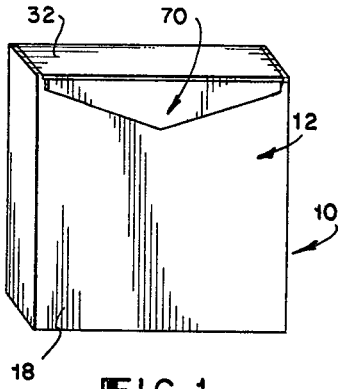
FIG. 1
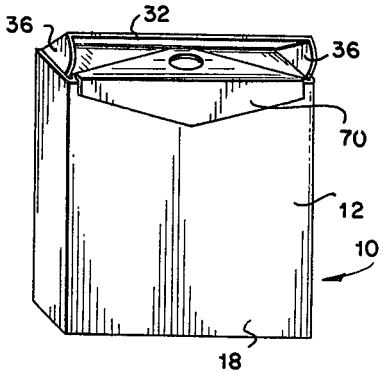
FIG. 2
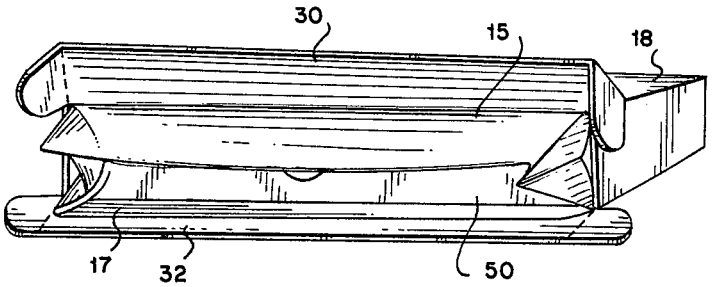
FIG. 3
FIG. 5
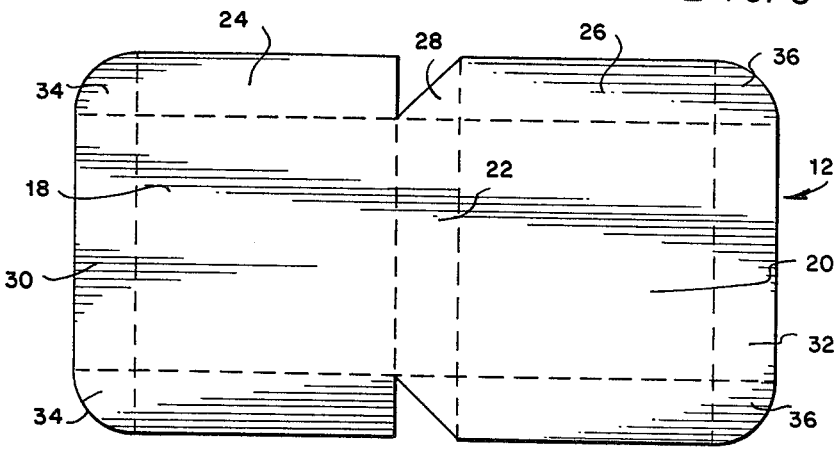

CONTAINER AND DISPENSING PACKAGE

BACKGROUND OF THE INVENTION

1. Field of the Invention

A container and dispensing package for cube sticks of foodstuffs such as butter.

2. Description of the Prior Art

Cartons of the general type described hereinafter have been on the market for years, usually used to contain four or more bars of individually wrapped butter. After the carton is opened, the bars of butter are removed by reaching therein and picking them up. The consumer or user is then faced with the messy task of removing the wrapper from around the bar of butter so that it can be used. This is unsanitary as well as time consuming in that it is likely that the user's hands will come in contact with the bar of butter during the unwrapping process. The expandable tray of the present invention provides a means of containing and exceptionally rapid dispensing of cube sticks of foodstuffs such as butter without being touched by human hands.

Moreover, packages have been developed with compartments which slide in and out of the container. Unfortunately the sides of the compartments are generally rigid and do not allow easy removal of unwrapped bars of butter. Neither do these compartments contain any type of retainer means to separate the top of the contents from the top of the carton so as to prevent the compartments with their contents from tumbling out of the carton.

In contrast, the instant invention relates to a package which contains and dispenses spread in a simple, sanitary and exceptionally rapid way by means of an expandable unit with anti-tumbling guards.

SUMMARY OF THE INVENTION

The subject of this invention relates to a unique and useful package with ease of access in a sanitary manner for cube sticks of foodstuffs such as butter. It is most suitable for the packaging of standard size bars of butter as normally available. This unique type of package permits the cube stick to be completely removed rapidly from its wrapper without the necessity of being touched by human hands. The full usefulness of this package is realized when it is used in conjunction with a spread dispensing device into which an unwrapped bar of butter can be quickly and easily loaded and standard size pats of butter dispensed without the butter ever being touched by human hands. In addition, the butter or spread can go from the package to a consumer or customer's butter dish without ever being touched by human hands. It is envisioned that the package and the spread dispensing device will be most useful in homes and restaurants where sanitary conditions are essential.

The package comprises an outer carton similar to those on the market, an expandable tray which contains the cube sticks within the carton and provides a means of conveniently removing them from the carton, and an inner wrapper to enclose the expandable unit with its cube sticks so as to keep them fresh and protected.

The expandable unit is comprised of a single piece of light cardboard folded in such a way as to form separate compartments or troughs into which individual cube sticks are placed. The expandable tray pulls out from the front in an accordion fashion with the result that the walls or partitions of the troughs fall away from the sides of the cube sticks. The bars of butter are thus laid bare and ready to be placed within a spread dispensing device or in a butter dish or otherwise used.

The structure of the opening is such that the accordion effect can be realized and the cube sticks pulled out merely by lightly pulling on an attachment flap located on the forward portion of the expandable tray.

The expandable tray also comprises retainer means for each compartment which act as guards between the cube sticks and the top of the outer carton. The retainer means are constructed by cutting portions from adjacent partitions to form guard flaps which lie between the cube sticks and the top of the outer carton. The package thus provides a unique means of storing and dispensing in a simple, sanitary and rapid manner.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of a closed container and dispensing package.

FIG. 2 is a similar perspective view of a container and dispensing package showing the package partially open.

FIG. 3 is a similar perspective view of a container and dispensing package showing the package further opened.

FIG. 5 is a perspective view of a blank from which an outer carton is formed.

Similar reference characters refer to similar parts throughout the several views of the drawings.

DETAILED DESCRIPTION OF THE PREFERRED EMBODIMENT

Figure 4:
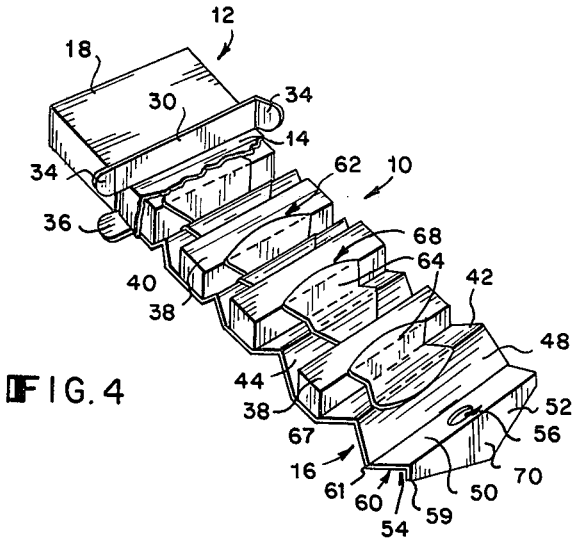
FIG. 4 is a perspective view of a container and dispensing package showing the expandable tray and its contents removed therefrom.

As best shown in FIG. 4, the present invention relates to a container and dispensing package generally indicated as 10 comprising an outer carton 12, and inner wrapper 14, and an expandable tray 16. The package 10 as more fully described hereinafter is a unique and useful container to store and provide ready access for cube sticks of foodstuffs such as butter in a quick and sanitary manner.

As best shown in FIG. 5, the outer carton 12 comprises an upper and lower wall 18 and 20 respectively together with end wall 22. A pair of upper and lower side flaps 24 and 26 respectively are formed on opposite sides of the upper and lower walls 18 and 20 to cooperatively form side walls when assembled. Rear flaps 28 are formed on end wall 22 while upper and lower end flaps 30 and 32 respectively are formed on opposite sides of upper and lower walls 18 and 20 respectively. Said upper and lower end flaps 30 and 32 respectively are disposed to engage and close the outer carton 12 when in first position and to disengage and open the outer carton 12 when in second position. Formed on opposite sides of upper and lower end flaps 30 and 32 respectively are upper and lower end tabs 34 and 36 respectively.

Figure 6:
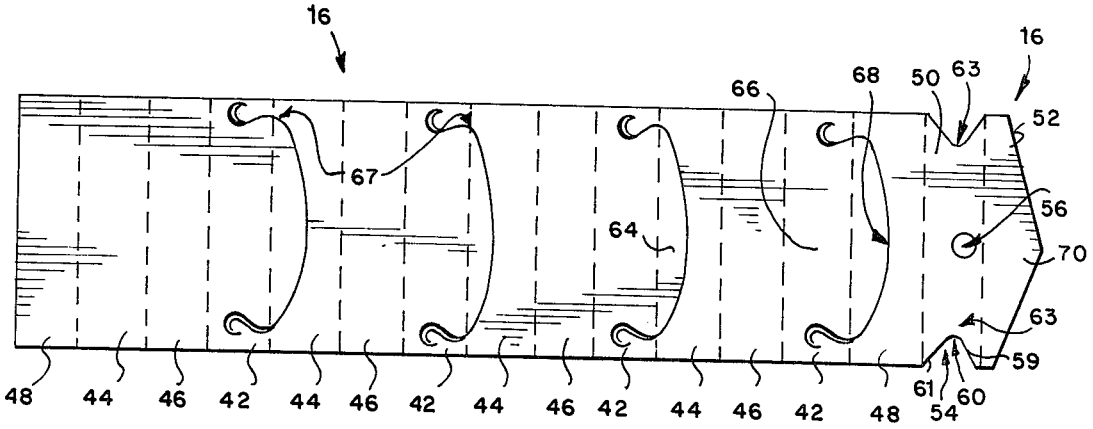
FIG. 6 is a perspective view of a blank from which an expandable tray is formed.

As best shown in FIGS. 4 and 6, the expandable tray 16 comprises a single piece of light cardboard or the like folded in such a way as to form a plurality of compartments or troughs 38 in which cube sticks of foodstuffs such as butter 40 are stored. FIG. 6 shows the expandable tray for four such troughs 38 prior to folding. Each trough 38 comprises a forward partition 42, a rear partition 44 and a floor 46 therebetween which forms the bottom of the trough. Each compartment 38 further includes a retainer means generally indicated as 62 on the forward portion of each trough 38. End walls 48 are attached at both the forward and rear portions of the plurality of troughs 38. Located adjacent to the forward end wall 48 is a separation flap 50 having an attachment flap 52 extending from the forward portion thereof. The rear partition 44 of each trough 38 is adjacent to the forward partition 42 of the next adjacent trough 38.

The separation flap 50 comprises a pair of wrapper folding and opening means 54 on opposite sides thereof and a separation flap aperture 56 formed near the center thereof adjacent the attachment flap 52. The wrapper folding and opening means 54 comprise substantially triangularly shaped segments 60 cut from opposite sides of the separation flap 50. The segments 60 each comprise first and second legs 59 and 61 respectively extending inwardly from the front and rear portions of the separation flap 50. The first and second legs 59 and 61 intersect at the included angle 63. The included angles 63 are concave to accommodate the wrapper 14 near the opening of the package 10. The attachment flap 52 is formed generally in the shape of an obtuse triangle with the obtuse angle at the forward center, forming an apex 70.

When the package 10 is closed as shown in FIG. 1, the attachment flap 52 lies outside the carton 12 and is adhesively attached to the upper wall 18 thereof. The separation flap 50 lies between the upper and lower end flaps 30 and 32 respectively of the outer carton 12 as best shown in FIG. 2. Of the three flaps, the upper end flap 30 is innermost in the carton 12. Forward and adjacent thereto is the separation flap 50. Adjacent thereto and forming the outside of the opening is the lower end flap 32. The upper and lower end flaps 30 and 32 respectively are adhesively attached to each other at their points of contact: the separation flap aperture 56 and the wrapper folding and opening means 54. Thus, the opening of the carton 12 is securely closed while the attachment flap 52 of tray 16 is allowed to extend outside the closed carton 12.

The retainer means 62 comprises a guard flap 64 and a spring member 66. With the exception of the forward most retainer means 62, the guard flaps 64 are constructed from the rear partition 44 of the most adjacent trough or compartment by cutting an obtuse triangle therefrom. The included angle which forms an apex 68 is located near the midpoint of the respective rear partition 44. The forward guard flap 64 is formed on the forward end wall 48 in the same manner. Angles 68 are rounded to prevent tearing.

Each spring member 66 is formed on the forward partition 42 by the continuation of the guard flaps 64 into the respective forward partitions 42. Each spring member 66 is formed by hook-shaped slots 67 on opposite sides thereof. As shown, the hook-shaped slots 67 curve outwardly toward the outer edge of the partitions 42. The lateral separation between the outermost extent of the guard flaps 64 and spring members 66 is substantially equal. The retainer means 62 thus formed is not attached to the rear partition 44, but tends to protrude from the expandable tray 16.

The inner wrapper 14 is comprised of wax paper or similar material which protects and keeps the materials contained within the expandable tray 16 fresh and free from moisture. The inner wrapper 14 substantially covers the expandable tray 16 as it lies within the outer carton 12. When the package 10 is in use and the expandable tray 16 is partially removed therefrom, the inner wrapper 14 extends past the opening of the package 10.

The excess of wax paper of the wrapper 14 near the opening of the package 10 is conveniently tucked in at the wrapper folding and opening means 54, when the package 10 is closed. At the rear of the package 10, the inner wrapper 14 is adhesively attached to the carton 12 so as to prevent the wrapper 14 from being removed therefrom when the expandable tray 16 is pulled out.

The package 10 is easily and conveniently opened by the user pulling on the attachment flap 52 at the apex 70 until the adhesive bond with the outer carton 12 is broken. The user's continued pulling on the attachment flap 52 causes the adhesive bond between the upper and lower end flaps 30 and 32 respectively to break and allowing each to open as the expandable tray 16 is pulled outwardly from the carton 12. Due to the construction of the wrapper folding and opening means 54 to accommodate the interfolding of the wrapper 14 therearound, the inner wrapper 14 pulls away from the front of the expandable tray 16, which then easily slides out of the carton 12.

As long as each of the troughs 38 remains inside the outer carton 12, the retainer means 62 causes the partitions 42 and 44 to remain substantially upright and parallel to the opening of the outer carton thus preventing the cube sticks from rolling or tumbling. This is accomplished by the guard flap 64 separating the cube stick from the wrapper 14 to prevent sticking and the spring member 66 creating a spring effect which supplements the effect of the guard flap 64.

As each respective trough 38 is pulled from the outer carton 12, the forward and rear partition 42 and 44 respectively fall away from the sides of the cube stick 40 to completely expose the cube stick 40 on the top of the floor 46 without it having been touched by human hands. In addition the cube stick can be dropped into a butter dish without the necessity of touching it. Because the partitions 42 and 44 fall away from the sides of the cube stick 40 as the expandable tray 16 is pulled out in accordion fashion, the cube sticks of foodstuffs 40 such as butter are much more accessible than if the expandable tray 16 were a compartmentalized drawer or slide as in the prior art.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A container and dispensing package for storing and dispensing contents therefrom comprising an outer carton having an opening therein and expandable tray for holding the contents of said package removably disposed within said outer carton, said expandable tray comprising a plurality of adjacent compartments each comprising a forward and a rear partition each movable between a first and second position, said forward and rear partitions disposed to engage the contents when in said first position and to disengage the contents when in said second position, a floor extending between said forward and rear partitions upon which the contents are placed, and means for at least partially removing said expandable tray from said outer carton, said means for at least partially removing said expandable tray from said outer carton comprises an attachment flap fixedly attached to the end of said expandable tray and removably attached to the outside of said outer carton such that said expandable tray can be removed from said outer carton by detaching said attachment flap from the outside of said outer carton and pulling thereon, said outer carton further comprises an upper and lower end flap attached on opposite sides of said opening of said outer carton and disposed to selectively engage and close said opening and to disengage and open said opening; said means for at least partially removing said expandable tray from said outer carton further comprises a separation flap attached to said expandable tray between said attachment flap and the outer most of said adjacent compartments and disposed between said upper and lower end flaps when said opening is closed.

2. The container and dispensing package of claim 1 wherein said forward and rear partitions are in said first position when each said respective compartment and its contents are substantially enclosed by said outer carton and in said second position when each said respective compartment and its contents are disposed outside of said outer carton, said forward and rear partitions substantially enclosing the sides of the contents when in said first position and inclined outwardly from the contents when in said second position.

3. A container and dispensing package for storing and dispensing contents therefrom comprising an outer carton having an opening therein and an expandable tray for holding the contents of the package removably disposed within said outer carton, said expandable tray comprising a plurality of adjacent compartments each comprising a forward and a rear partition each movable between a first and second position, said forward and rear partitions disposed to engage the contents when in said first position and to disengage the contents when in said second position, a floor extending between said forward and rear partitions upon which the contents are placed, and means for at least partially removing said expandable tray from said outer carton, each said compartment further comprises a retainer means formed thereon to retain the contents secure therein as each said corresponding compartment of said expandable tray is removed from said outer carton, said retainer means comprises a guard flap disposed between the top of the contents and the top of said package to prevent the contents from engaging the top of said package and a spring member extending from said expandable tray, said spring member being attached to said guard flap to maintain said guard flap between the top of the contents and the top of said package.

4. The container and dispensing package of claim 3 wherein said guard flap is formed from the rear partition of the forward adjacent compartment by forming a first slit therein and said spring member is formed from the forward partition of said each individual compartment by forming a pair of slits extending from opposite sides of said first slit.

5. The container and dispensing package of claim 4 wherein said pair of second slits of said forward partition are hook-shaped elements.

6. The container and dispensing package of claim 5 wherein the upper and lower outer edges of each said respective hook-shaped elements are equal distant from the outer edges of each said compartment.

* * * * *